US011123750B2

(12) United States Patent
Krichtafovitch

(10) Patent No.: US 11,123,750 B2
(45) **Date of Patent: *Sep. 21, 2021**

(54) ELECTRODE ARRAY AIR CLEANER

(71) Applicant: AGENTIS AIR LLC, Columbia, MD (US)

(72) Inventor: Igor Krichtafovitch, Kiev (UA)

(73) Assignee: AGENTIS AIR LLC, Columbia, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/060,846

(22) Filed: Oct. 1, 2020

(65) Prior Publication Data

US 2021/0078015 A1 Mar. 18, 2021

Related U.S. Application Data

(63) Continuation of application No. 16/219,750, filed on Dec. 13, 2018, now Pat. No. 10,792,673.

(51) Int. Cl.
*B03C 3/38* (2006.01)
*B03C 3/09* (2006.01)
(Continued)

(52) U.S. Cl.
CPC ..... *B03C 3/38* (2013.01); *B03C 3/09* (2013.01); *B03C 3/41* (2013.01); *B03C 3/47* (2013.01); *B03C 2201/04* (2013.01)

(58) Field of Classification Search
CPC combination set(s) only.
See application file for complete search history.

(56) References Cited

U.S. PATENT DOCUMENTS 1,650,097 A 11/1927 Schmidt
1,931,436 A 10/1933 Walther
(Continued)

FOREIGN PATENT DOCUMENTS

CN 2319732 Y 5/1999
CN 1926651 A 3/2007
(Continued)

OTHER PUBLICATIONS

Wen, T-Y., Wang H. Krischtofovich, I., Mamishev, A., Novel Electrodes of an Electrostatic Precipitator for Air Filtration, submitted to Journal of Electronics Nov. 12, 2014, Journal of Electrostatics, 73 (2015), pp. 117-124 (Year 2014).

*Primary Examiner* — Christopher P Jones
*Assistant Examiner* — Sonji Turner
(74) *Attorney, Agent, or Firm* — Ungerman IP PLLC; Mark E. Ungerman

(57) ABSTRACT

An electrostatic air cleaner may include a corona charging stage, a precipitation stage, and an air mover (fan). The corona charging stage may include a first and second array placed under electrical potential difference capable of generating a corona discharge. The first array may be substantially parallel corona wires and may be located downstream of an air penetrable second array. The precipitation stage may be downstream from the corona charging stage. The spacing between the first array and the second array may be less than the distance of the precipitation stage to the second array. The air mover may be upstream of the corona charging stage or downstream of the precipitation stage or between these stages. The arrangement allows for higher ion output downstream of the first array with the same voltage and power consumption resulting in greater particle charging and better air cleaning efficiency.

5 Claims, 1 Drawing Sheet

(51) Int. Cl.
*B03C 3/47* (2006.01)
*B03C 3/41* (2006.01)

(56) References Cited

U.S. PATENT DOCUMENTS 1,957,560 A 5/1934 Thompson
2,142,129 A 1/1939 Wilhelm et al.
2,271,597 A 2/1942 Lionel
2,526,402 A 10/1950 Palmer
2,571,079 A 10/1951 Warburton
2,588,111 A 3/1952 Gorden
2,672,207 A 3/1954 Hedberg Carl
2,771,963 A 11/1956 Warren
2,997,130 A 8/1961 Nodolf
3,040,497 A 6/1962 Schwab
3,157,479 A 11/1964 Boles
3,452,225 A 6/1969 Gourdine
3,504,482 A 4/1970 Goettl
3,518,462 A 6/1970 Brown
3,710,588 A 1/1973 Martinez
3,751,715 A 8/1973 Edwards
3,816,980 A 6/1974 Schwab
3,831,351 A 8/1974 Gibbs et al.
3,959,715 A 5/1976 Canning
3,960,505 A 6/1976 Marks
4,057,405 A 11/1977 Cheney et al.
4,077,785 A 3/1978 Hartshorn
4,098,591 A 7/1978 Diepenbroek et al.
4,124,359 A 11/1978 Geller
4,160,202 A 7/1979 James et al.
4,166,729 A 9/1979 Thompson et al.
4,177,047 A 12/1979 Goland
4,178,156 A 12/1979 Tashiro et al.
4,231,766 A 11/1980 Spurgin
4,246,010 A 1/1981 Honacker
4,259,093 A 3/1981 Vlastos et al.
4,259,707 A 3/1981 Penney
4,264,343 A 4/1981 Natarajan et al.
4,290,003 A 9/1981 Lanese
4,390,830 A 6/1983 Laugesen
4,390,831 A 6/1983 Byrd et al.
4,433,281 A 2/1984 Herklotz et al.
4,486,704 A 12/1984 Gustafsson et al.
4,490,159 A 12/1984 Malls
4,516,991 A 5/1985 Kawashima
4,549,887 A 10/1985 Joannou
4,604,112 A 8/1986 Ciliberti et al.
4,613,346 A 9/1986 Reyes et al.
4,643,745 A 2/1987 Sakakibara et al.
4,673,416 A 6/1987 Sakakibara et al.
4,689,056 A 8/1987 Noguchi et al.
4,719,535 A 1/1988 Zhenjun et al.
4,789,801 A 12/1988 Lee
4,904,283 A 2/1990 Hovis et al.
4,980,796 A 12/1990 Huggins
5,035,728 A 7/1991 Fang
5,055,118 A 10/1991 Nagoshi et al.
5,068,811 A 11/1991 Johnston et al.
5,108,470 A 4/1992 Pick
5,123,524 A 6/1992 Lapeyre
5,251,171 A 10/1993 Yamauchi
5,254,155 A 10/1993 Mensi
5,330,559 A 7/1994 Cheney et al.
5,332,485 A 7/1994 Thompson
5,332,562 A 7/1994 Kersey et al.
5,336,299 A 8/1994 Savell
5,395,430 A 3/1995 Lundgren et al.
5,466,279 A 11/1995 Hattori et al.
5,526,402 A 6/1996 Dent et al.
5,573,577 A 11/1996 Joannou
5,628,818 A 5/1997 Smith et al.
5,679,121 A 10/1997 Kim
5,689,177 A 11/1997 Nielsen et al.
5,707,428 A 1/1998 Feldman et al.
5,807,425 A 9/1998 Gibbs
5,827,407 A 10/1998 Wang et al.
5,846,302 A 12/1998 Putro
5,914,454 A 6/1999 Imbaro et al.
5,922,111 A 7/1999 Omi et al.
5,993,521 A 11/1999 Loreth et al.
6,129,781 A 10/2000 Okamoto et al.
6,187,271 B1 2/2001 Lee et al.
6,245,131 B1 6/2001 Rippelmeyer et al.
6,251,171 B1 6/2001 Marra et al.
6,504,308 B1 1/2003 Krichtafovitch et al.
6,527,834 B1 3/2003 Jörder et al.
6,635,106 B2 10/2003 Katou et al.
6,656,248 B2 12/2003 Ilmasti
6,660,061 B2 12/2003 Josephson et al.
6,764,533 B2 7/2004 Lobiondo, Jr.
6,805,732 B1 10/2004 Billiotte et al.
6,831,271 B1 12/2004 Guevremont et al.
6,888,314 B2 5/2005 Krichtafovitch et al.
6,937,455 B2 8/2005 Krichtafovitch et al.
6,984,987 B2 1/2006 Taylor et al.
7,008,469 B2 3/2006 Vetter et al.
7,019,244 B2 3/2006 Weaver et al.
7,048,780 B2 5/2006 Kim et al.
7,112,238 B2 9/2006 Joannou
7,150,780 B2 12/2006 Krichtafovitch et al.
7,163,572 B1 1/2007 Liang et al.
7,182,805 B2 2/2007 Reaves
7,264,659 B1 9/2007 Moshenrose
7,316,735 B2 1/2008 Tomimatsu et al.
7,332,019 B2 2/2008 Bias et al.
7,351,274 B2 4/2008 Helt et al.
7,393,385 B1 7/2008 Coffey et al.
7,405,672 B2 7/2008 Taylor et al.
7,431,755 B2 10/2008 Kobayashi et al.
7,438,743 B2 10/2008 Strauss
7,452,410 B2 11/2008 Bergeron et al.
7,513,933 B2 4/2009 Coppom et al.
7,531,027 B2 5/2009 Tepper et al.
7,534,288 B2 5/2009 Bromberg
7,553,353 B2 6/2009 Lepage
7,569,100 B2 8/2009 Tanaka et al.
7,582,144 B2 9/2009 Krigmont
7,582,145 B2 9/2009 Krigmont
7,594,958 B2 9/2009 Krichtafovitch et al.
7,597,750 B1 10/2009 Krigmont
7,608,135 B2 10/2009 Mello et al.
7,652,431 B2 1/2010 Krichtafovitch
7,717,980 B2 5/2010 Tepper et al.
7,736,418 B2 6/2010 Graβ
7,753,994 B2 7/2010 Motegi et al.
7,758,675 B2 7/2010 Naito et al.
7,780,761 B2 8/2010 Gu et al.
7,815,719 B2 10/2010 McKinney et al.
7,833,322 B2 11/2010 Botvinnik et al.
7,857,884 B2 12/2010 Bohlen
7,857,890 B2 12/2010 Paterson et al.
7,896,957 B2 3/2011 Zhao et al.
7,914,604 B2 3/2011 Mello et al.
7,942,952 B2 5/2011 Gale
7,998,255 B2 8/2011 Blum
8,043,412 B2 10/2011 Carlson
8,049,426 B2 11/2011 Krichtafovitch et al.
8,092,768 B2 1/2012 Miller et al.
8,211,208 B2 7/2012 Chan et al.
8,241,396 B2 8/2012 Ursem et al.
8,241,397 B2 8/2012 Gu et al.
8,277,541 B2 10/2012 Hunt et al.
8,278,797 B2 10/2012 Sashida
8,349,052 B2 1/2013 Noh et al.
8,357,233 B2 1/2013 Chan
8,366,813 B2 2/2013 Tokuda et al.
8,388,900 B2 3/2013 Benedek et al.
8,404,020 B2 3/2013 Farmer et al.
8,414,687 B2 4/2013 Li
8,454,733 B2 6/2013 Tanaka et al.
8,460,433 B2 6/2013 Gefter et al.
8,492,733 B1 7/2013 Klochkov et al.
8,506,674 B1 8/2013 Brown-Fitzpatrick et al.
8,551,228 B2 10/2013 Chan

(56) References Cited

U.S. PATENT DOCUMENTS

| | | | |
|---|---|---|---|
| 8,574,345 | B2 | 11/2013 | Ursem et al. |
| 8,597,415 | B2 | 12/2013 | Noh et al. |
| 8,608,826 | B2 | 12/2013 | Al-Hamouz |
| 8,608,838 | B2 | 12/2013 | Wong et al. |
| 8,623,116 | B2 | 1/2014 | Karlsson |
| 8,624,476 | B2 | 1/2014 | Sekoguchi |
| 8,663,362 | B2 | 3/2014 | Hagan |
| 8,690,996 | B2 | 4/2014 | Ji et al. |
| 8,702,848 | B2 | 4/2014 | Kulprathipanja et al. |
| 8,721,775 | B2 | 5/2014 | Chesebrough |
| 8,736,043 | B2 | 5/2014 | Konno et al. |
| 8,741,018 | B2 | 6/2014 | Belcher et al. |
| 8,760,830 | B2 | 6/2014 | Ikeda |
| 8,845,782 | B2 | 9/2014 | Metteer |
| 8,873,215 | B2 | 10/2014 | Waddell |
| 8,889,079 | B2 | 11/2014 | Zahedi |
| 8,920,537 | B2 | 12/2014 | Seike |
| 8,999,040 | B2 | 4/2015 | Johansson |
| 9,028,588 | B2 | 5/2015 | Hess |
| 9,089,849 | B2 | 7/2015 | Gu et al. |
| 9,216,233 | B2 | 12/2015 | Ota et al. |
| 9,308,537 | B2 | 4/2016 | Krichtafovitch |
| 9,308,538 | B2 | 4/2016 | Genereux et al. |
| 9,327,293 | B2 | 5/2016 | McKinney et al. |
| 9,387,487 | B2 | 7/2016 | McGrath |
| 9,441,845 | B2 | 9/2016 | Waddell |
| 9,453,651 | B2 | 9/2016 | Park et al. |
| 9,457,118 | B2 | 10/2016 | Ota et al. |
| 9,488,382 | B2 | 11/2016 | Krichtafovitch |
| 9,550,189 | B2 | 1/2017 | Oertmann |
| 9,630,186 | B2 | 4/2017 | Back |
| 9,797,864 | B2 | 10/2017 | McKinney |
| 9,827,573 | B2 | 11/2017 | Afanasiev et al. |
| 10,168,059 | B2 | 1/2019 | Yamaguchi et al. |
| 2002/0134932 | A1 | 9/2002 | Guevremont et al. |
| 2002/0152890 | A1 | 10/2002 | Leiser |
| 2002/0190658 | A1 | 12/2002 | Lee |
| 2003/0005824 | A1 | 1/2003 | Katou et al. |
| 2003/0090209 | A1 | 5/2003 | Krichtafovitch et al. |
| 2003/0131727 | A1 | 7/2003 | Fissan et al. |
| 2004/0023411 | A1 | 2/2004 | Fenn |
| 2004/0105802 | A1 | 6/2004 | Duncan et al. |
| 2004/0212329 | A1 | 10/2004 | Krichtafovitch et al. |
| 2006/0177356 | A1 | 8/2006 | Miller |
| 2006/0185511 | A1 | 8/2006 | Tepper |
| 2006/0278074 | A1 | 12/2006 | Tseng et al. |
| 2006/0278082 | A1 | 12/2006 | Tomimatsu et al. |
| 2006/0286017 | A1 | 12/2006 | Hakka |
| 2007/0028767 | A1 | 2/2007 | Choi et al. |
| 2007/0148061 | A1 | 6/2007 | Lau et al. |
| 2008/0030920 | A1 | 2/2008 | Krichtafovitch et al. |
| 2008/0092743 | A1 | 4/2008 | Taylor et al. |
| 2008/0121106 | A1 | 5/2008 | Tepper et al. |
| 2008/0282772 | A1 | 11/2008 | Petinarides |
| 2009/0114090 | A1 | 5/2009 | Gu et al. |
| 2009/0235817 | A1 | 9/2009 | Gu et al. |
| 2009/0235821 | A1 | 9/2009 | Mochizuki et al. |
| 2009/0320426 | A1 | 12/2009 | Braunecker et al. |
| 2010/0051709 | A1 | 3/2010 | Krichtafovitch et al. |
| 2010/0089240 | A1 | 4/2010 | Krichtafovitch |
| 2010/0095848 | A1 | 4/2010 | Chang et al. |
| 2010/0155025 | A1 | 6/2010 | Jewell-Larsen et al. |
| 2010/0229724 | A1 | 9/2010 | Tokuda et al. |
| 2010/0236411 | A1 | 9/2010 | Chan |
| 2010/0243885 | A1 | 9/2010 | Tepper et al. |
| 2011/0084611 | A1 | 4/2011 | Schlitz et al. |
| 2011/0286892 | A1 | 11/2011 | Taylor et al. |
| 2012/0073436 | A1 | 3/2012 | Li |
| 2013/0021715 | A1 | 1/2013 | Jewell-Larsen et al. |
| 2013/0047857 | A1 | 2/2013 | Bohlen |
| 2013/0047858 | A1 | 2/2013 | Bohlen et al. |
| 2013/0047859 | A1 | 2/2013 | Bohlen |
| 2013/0074690 | A1 | 3/2013 | Tomimatsu et al. |
| 2013/0098247 | A1 | 4/2013 | Chan |
| 2013/0220128 | A1 | 8/2013 | Gu et al. |
| 2013/0276417 | A1 | 10/2013 | Winters et al. |
| 2013/0284025 | A1 | 10/2013 | Johansson et al. |
| 2014/0150659 | A1 | 6/2014 | McGrath |
| 2014/0174294 | A1 | 6/2014 | Krichtafovitch |
| 2014/0345463 | A1 | 11/2014 | Urata et al. |
| 2014/0373717 | A1 | 12/2014 | Wang |
| 2015/0013541 | A1 | 1/2015 | Vandenbelt et al. |
| 2015/0059580 | A1 | 3/2015 | Clement et al. |
| 2015/0246595 | A1 | 9/2015 | Forejt et al. |
| 2015/0260147 | A1 | 9/2015 | Schenk et al. |
| 2015/0323217 | A1 | 11/2015 | Krichtafovitch |
| 2015/0343454 | A1 | 12/2015 | Tyburk |
| 2016/0013013 | A1 | 1/2016 | Waddell |
| 2016/0074876 | A1 | 3/2016 | Afanasiev et al. |
| 2016/0074877 | A1 | 3/2016 | Afanasiev et al. |
| 2016/0184834 | A1 | 6/2016 | Genereux et al. |
| 2016/0236205 | A1 | 8/2016 | Seeley et al. |
| 2017/0008008 | A1 | 1/2017 | Umase |
| 2017/0021363 | A1 | 1/2017 | Krichtafovitch |
| 2017/0072406 | A1 | 3/2017 | Yamaguchi et al. |
| 2017/0354977 | A1 | 12/2017 | Krichtafovitch |
| 2017/0354979 | A1 | 12/2017 | Krichtafovitch |
| 2017/0354980 | A1 | 12/2017 | Krichtafovitch |
| 2017/0354981 | A1 | 12/2017 | Krichtafovitch |
| 2018/0015482 | A1 | 1/2018 | Rothenberg et al. |

FOREIGN PATENT DOCUMENTS

| | | | |
|---|---|---|---|
| CN | 201210251 | Y | 3/2009 |
| CN | 100552854 | C | 10/2009 |
| CN | 101657247 | B | 2/2010 |
| CN | 103706479 | A | 4/2014 |
| CN | 105034756 | A | 11/2015 |
| CN | 205066003 | U | 3/2016 |
| DE | 4114935 | A1 | 11/1991 |
| EP | 0332624 | B1 | 1/1992 |
| EP | 2700452 | A2 | 2/2014 |
| GB | 1490315 | A | 11/1977 |
| WO | 2010025811 | A1 | 3/2010 |
| WO | 2012039826 | A2 | 3/2012 |
| WO | 2013173528 | A1 | 11/2013 |
| WO | 2015084112 | A1 | 6/2015 |

ELECTRODE ARRAY AIR CLEANER

CROSS-REFERENCE TO RELATED APPLICATION

This application is a continuation of U.S. application Ser. No. 16/219,750 filed Dec. 13, 2018.

BACKGROUND OF THE INVENTION

1. Field of the Invention

This invention relates to air cleaners, and particularly to electrostatic air cleaners.

2. Description of the Related Technology

Various electrostatic air cleaner designs are known. One significant advantage of electrostatic air cleaners is the possibility of operating at a lower pressure drop compared to conventional mechanical filter air cleaners. A large pressure drop requires a powerful fan to provide the desired air flow rate, which causes noisy operation of the air cleaner.

A conventional electrostatic air cleaner may have a charging stage for charging particles in the air stream through the filter and a dust precipitation stage. The pressure drop across the air cleaner can be arranged to be near zero. The charging stage is typically a high voltage ionizer and may be arranged as a series of corona discharge electrodes (most often in the form of fine wires) sandwiched between grounded plates. Corona discharge requires sufficient voltage and power to ionize air molecules in the vicinity of the corona discharge electrodes. The corona electrodes rapidly discharge ions of one polarity that drift according to an electric field towards the grounded plates. Particles entrained in the air stream collide with these drifting ions.

U.S. Pat. No. 5,330,559 describes an electrostatic air cleaner employing a corona discharge charging stage. An ionizer is placed on the inlet side of an electrostatic air cleaning apparatus with alternating ground plates and high voltage discharge electrodes placed side-by-side.

A problem with electrostatic air cleaners of this kind is the corona discharge power consumption and by-product (like Ozone) generation.

U.S. Patent Application No. 2015/0323217 shows an electronic air cleaner with an ionizing stage at the inlet end of the cleaner. The ionizing stage has alternating corona electrodes and exciting electrodes, side-by-side. A similar configuration is shown in U.S. Pat. No. 2,526,402.

In conventional electrostatic air cleaners, ions flow from the corona discharge electrodes (thin wires) to the second array. Typically, a majority of the ions reach the second array (usually grounded) before they collide with the airborne particles. These ions are wasted.

U.S. Pat. No. 6,251,171 shows an electrostatic air cleaner with a charging stage having, in the direction of air flow, a first row of equally spaced parallel thick grounded wires in a plane perpendicular to the air flow, a row of equally-spaced parallel thin corona wires offset from the first row of grounded wires in a plane perpendicular to the air flow direction. Next, there is a second row of equally-spaced parallel thin wires which are under high voltage potential aligned with thick grounded wires in the third row. The grounded wires in the first and third rows may have chromium-nickel wires having diameter of approximately 1.0 mm. Alternatively, the first and third arrays of grounded wires may each be obtained by chemical etching of a metal plate, in which case the wires could, for example, be stainless steel and have a thickness of at least 0.5 mm to enable etching from a solid plate.

Two arrays of grounded wires may be mounted as close together as practical, for example, 20 mm, the spacing between adjacent grounded wires may be approximately 4 mm.

The corona wires are described as having the smallest possible diameter (a diameter of approximately 0.05 mm is preferred) since any reduction in the diameter below this level results in mechanical weakness of the wires. The corona wires may be made from tungsten.

The corona wires may be set off from the grounded wires with respect to the direction of air flow so that the air stream crosses the electric field lines which are defined between the corona wires and the grounded wires. Uniform dust particle charging may be achieved when the orientation of the electric field is perpendicular to the air flow direction.

U.S. Pat. No. 6,251,171 further discloses that the spacing between the corona wires (8 mm) is twice the spacing between the grounded wires (4 mm).

U.S. Pat. No. 6,251,171 shows a precipitation stage with a series of alternated grounded plates and high voltage plates extending parallel to each other and parallel to the direction of air flow through the air cleaner. In this way, the precipitation stage introduces only a negligible pressure drop. The plates in the precipitation stage may have a thickness of approximately 0.5 mm. The voltage supplied to the high voltage plates, and the separation between adjacent plates defines the electric field strength between the plates. The same voltage source may be used for the high voltage plates as for the corona wires, and the spacing between adjacent plates may be approximately 2 mm.

In the configuration shown in U.S. Pat. No. 6,251,171 many of the ions are emitted from the corona electrodes travel toward the precipitation stage. Many of those ions meet the grounded third raw and settle on the grounded thick wires. This reduces the number of ions that escape the charging stage and take part in charging dust particles. The cleaning efficiency of the electrostatic air cleaner is therefore reduced.

SUMMARY OF THE INVENTION

An electrostatic precipitator (ESP) is a filtration device that removes particles, like dust and smoke, from a flowing gas using the force of an induced electrostatic charge minimally impeding the flow of gases through the device. Electrostatic precipitators may be used as air filters, purifiers, and/or conditioners. An electrostatic precipitator may have several types of electrodes. One type of electrode is a corona electrode. Another type may be collecting electrodes. There may be other types of electrodes such as an exciting electrode and a repelling electrodes. Each type of electrode referred to herein may be a single electrode or plural electrodes or an electrode array. Typically, electrodes of the same type of kept at the same potential. The exciting electrode may be a single piece structure or more than one piece electrically connected to each other. The corona electrodes may be a corona wire routed across the air flow path one time or more than one time and an electrostatic device may have one corona wire or multiple corona wires routed across an airflow path and electrically connected to each other. The term "electrode array" is intended to include one or more electrodes of the same type. Electrode arrays may be mounted such that one or more electrodes arrays may be removable to facilitate cleaning and/or replacement.

According to the advantageous features of the present invention, an air cleaner may remove particles contained in an air stream directed through an air cleaner. The air cleaner may include a charging stage for charging particles in the air stream and a precipitation stage for capturing charged particles. It is an object to provide a high ion density downstream of ionization area to increase the probability that particles in the air stream will be charged. The charging stage may have a first array of substantially parallel thin wires and a second array may be made of electrically conductive air penetrable mesh. The second array may be located upstream of the first array and may be electrically grounded. A corona discharge takes place when sufficient voltage is applied between the first and second arrays. The first array emits ions that are electrically attracted to the second array and move toward the second array. The system may have an airflow induced by a fan in the opposite direction of the ions movement. Advantageously the air flow induced by the fan may be of a sufficient magnitude to divert emitted ions away from the second array and increase concentration of ions downstream of the charging stage in order to increase the probability of an ion colliding with an airborne particle and settling on a downstream collector.

As a result of the air flow induced by the fan a majority of the ions do not reach the second array. These ions flow from the first array toward the precipitation stage. On the way to the precipitation stage, the ions settle on the dust particles and charge them. Charged particles enter the precipitation stage and settle on the collecting electrodes. The precipitation stage usually has two arrays of parallel plates (electrodes). The first array of precipitation stage are collecting electrodes and these plates are usually grounded. The second array of electrodes are the repelling electrodes and they are usually under the same voltage polarity as the first array (usually positive).

An electrostatic air cleaner may have an ionizing stage including a first electrode array located in the airflow path downstream from the second electrode array, wherein the first electrode array may include one or more substantially parallel thin wires. A precipitation stage may be located in the airflow path downstream of the ionizing stage and having at least a collecting electrode array. The second electrode array defines a second electrode array plane and said second electrode array plane is orthogonal to the airflow path. A high voltage power supply may be connected between the first electrode array and the second electrode array of the ionizing stage with an output electrical potential between a corona onset voltage and a breakdown voltage of the first electrode array and the second electrode array. The electrode configuration may be such that an ion concentration downstream of the ionizing stage is equal or larger than the ion concentration between the second electrode array and the first electrode array when under the influence of an air mover. The first electrode array may be located at a first distance from the second electrode array. The precipitation stage is located at a distance from said second electrode array that is at least 1.5 times greater than the first distance. The second electrode array of the ionizing stage may be connected to a power supply at an electrical potential equal to the ground or to a safe electrical potential for humans, for instance less than 12 V. The first electrode array is normally under positive electrical potential relative to the second electrode array.

Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

The invention will now be described by way of example, with reference to and as shown in the accompanying drawings.

DETAILED DESCRIPTION OF THE PREFERRED EMBODIMENTS

Before the present invention is described in further detail, it is to be understood that the invention is not limited to the particular embodiments described, as such may, of course, vary. It is also to be understood that the terminology used herein for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

Figure 1:
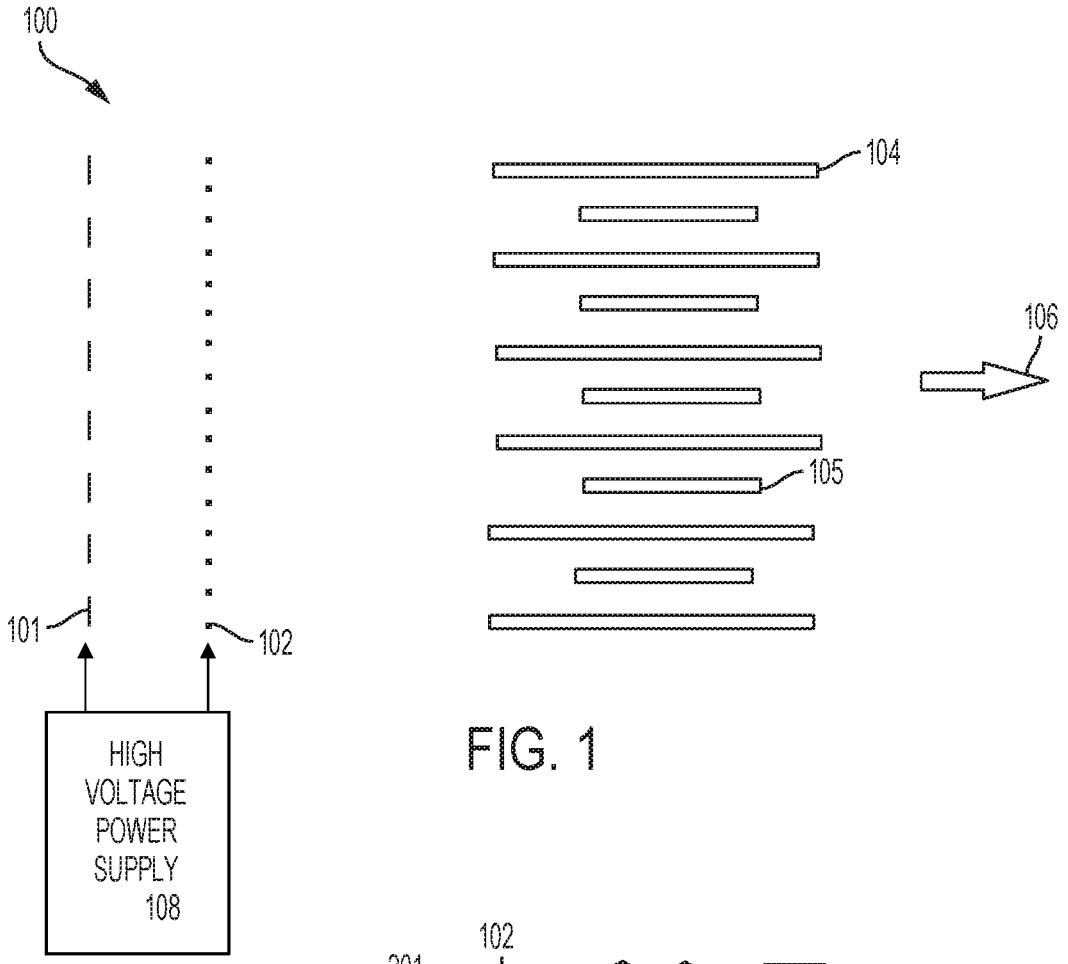
FIG. 1 shows a schematic of an electrode configuration in an electrostatic air cleaner.

FIG. 1 shows a schematic of an electrostatic air cleaner 100 with a charging stage and a precipitation stage. The charging stage includes a first array 102 and a second array 101. The second array 101 may be an air penetrable mesh and the first array 102 may be wires. The second array 101 may be an exciting electrode set. The first array 102 may be a corona electrode set. A potential difference of several kilovolts or greater may be applied by a high voltage power supply 108 between the first array and the second array. The first array 102 may be under positive electrical potential, in one example, in a range between 10 kV and 20 kV. The second array 101 is usually grounded. The electrical potential applied between these arrays should be substantial and at a level between the corona onset voltage and the breakdown voltage.

A fan (not shown) may also be part of the air cleaner 100 and may blow air in the direction depicted by the arrow 106.

The precipitation stage may include one or more collecting electrodes 104 and one or more repelling electrodes 105. Usually the collecting electrodes 104 are grounded and the repelling electrodes 105 are under high voltage potential of the same polarity as the voltage applied to the first array 102.

Any electrical potential may be applied to each of these electrodes providing that the potential difference between them is substantial enough to draw charged particles away from the repelling electrodes 105 toward the collecting electrodes 104. The repelling electrodes 105 are usually under positive electrical potential, for example, in the range from 5 kV to 15 kV. The repelling electrodes 105 may be connected to the first array 102 directly or via an electrical resistor (not shown).

Ions emitted from the first array 102 travel, under the influence of an air mover such as a fan, toward the precipitation stage and settle on the dust particles in the air. These particles become electrically charged and enter the area between the collecting 104 and repelling 105 electrodes.

The more ions are in the air between the first array 102 and the precipitation stage, the greater the chances that they encounter dust particles and charge them.

Figure 2:
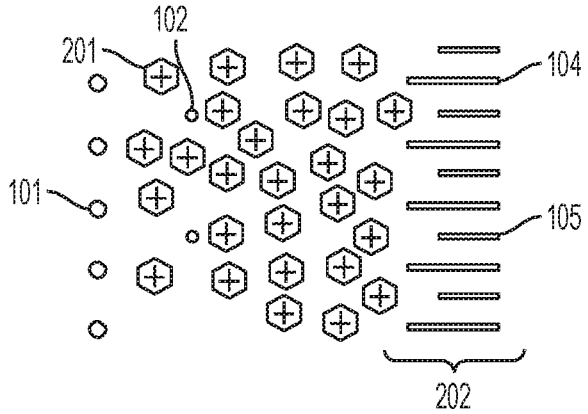
FIG. 2 shows a schematic representation of art ions concentration in an electrostatic air cleaner as described herein.

FIG. 2 schematically shows ions 201 blown by the fan toward the precipitation stage 202. The ion count and number of dust particles charged are increased and thereby collection efficiency of the electrostatic air cleaner is increased.

In an experiment comparing ion counts at an output of a precipitator where the collector stage air velocity and inlet particle count was held constant the respective ion counts at the outlet are given for two charging stage configurations. The first charging stage configuration had an electrode geometry as shown in FIGS. 1 and 2 namely a row of equally-spaced parallel grounded wires and a second row of equally-spaced parallel corona wires offset from the grounded wires. The distance between the two rows was 20 mm. The spacing between grounded wires was 15 mm and the spacing between corona wires was 20 mm.

The second charging stage configuration had an electrode geometry corresponding to U.S. Pat. No. 6,251,171, specifically a first row of equally-spaced parallel grounded wires having a spacing of 10 mm per wire followed by a row of equally-spaced parallel corona wires. The row of corona wires was arranged 20 mm from the first row of grounded wires. The spacing between corona wires was 20 mm and the corona wires were offset from the first row of grounded wires. A second row of ground wires was spaced 20 mm from the row of corona wires. The second row of ground wires were parallel and equally-spaced with 15 mm between each.

All grounded wires were of the diameter equal to 2 mm and all corona wires were of the diameter 0.1 mm.

The experiment was performed using corona voltages as shown in each case with an output ion count downstream of the ionizing stage. Table 1 shows the results using the second electrode configuration corresponding to the configuration geometry shown in U.S. Pat. No. 6,251,171.

TABLE 1

| Voltage | Ions count $*10^3/cm^3$ at the outlet |
|---|---|
| 13.9 | 0 |
| 14 | 1.7 |
| 14.5 | 11 |
| 15 | 16 |
| 16 | 23 |
| 17 | 29 |
| 18 | 34 |
| 19 | 43 |
| 20 | 47 |

Table 2 shows the results using the first electrode configuration described above.

TABLE 2

| Voltage | Ions count $*10^3/cm^3$ |
|---|---|
| 12.5 | 3 |
| 13 | 8 |
| 14 | 86 |
| 14.5 | 100 |
| 15 | 115 |
| 16 | 140 |
| 17 | 152 |
| 18 | 180 |
| 19 | 198 |
| 20 | >200 |

The ion count in Table 1 is dramatically lower than the ion count shown in Table 2. Table 1 shows that the maximum ion count at the output at the ionizer was only about 47,000 ions per cubic centimeter.

The collecting efficiency of the electrostatic air cleaner shown in Table 1 is measured at a level between 80-85% for the particles in the range between 0.3-5 microns.

The experimental results shown in Table 2 amount to approximately a 5-fold increase in the number of ions at the output of the ionizer. At a corona voltage of 20 kV the ion count was more than 200,000 per cubic centimeter.

The collecting efficiency of the electrostatic air cleaner shown in the Table 2 is measured at a level above 99% for the particles in the range between 0.3-5 microns.

The techniques, processes and apparatus described may be utilized to control operation of any device and conserve use of resources based on conditions detected or applicable to the device.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of the present invention have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. An air cleaner comprising:

an ionizing stage including a first electrode array located in an airflow path and arranged to be air penetrable and a second electrode array at an electrical potential of ground to 12 volts, arranged to be air penetrable located in said airflow path upstream from said first electrode array, wherein said first electrode array includes one or more ion emitting members;

a particle collection stage located in said airflow path downstream of said ionizing stage; and a high voltage power supply connected between said first electrode array and said second electrode array having an output electrical potential between a corona onset voltage and a breakdown of said first electrode array and said second electrode array.

2. The air cleaner according to claim 1, where the first electrode array is under positive electrical potential relative to the second electrode array.

3. The air cleaner according to claim 1, where the first electrode array comprises thin electrically conductive wires.

4. The air cleaner according to claim 1, where the second electrode array comprises electrically conductive air penetrable web.

5. The air cleaner according to claim 1, wherein said second electrode array defines a second electrode array plane and wherein said second electrode array plane is orthogonal to said airflow path.

* * * * *